US006039591A

United States Patent [19]

Marsh et al.

[11] Patent Number: 6,039,591

[45] Date of Patent: Mar. 21, 2000

[54] LOCKING ELECTRICAL CONNECTOR

[75] Inventors: Richard N. Marsh, Cool; Demian T. Martin, Oakland, both of Calif.

[73] Assignee: Monster Cable Products, Inc., Brisbane, Calif.

[21] Appl. No.: 08/887,885

[22] Filed: Jul. 3, 1997

[51] Int. Cl.[7] ..... H01R 13/15

[52] U.S. Cl. ..... 439/265

[58] Field of Search ..... 439/265, 346

[56] References Cited

U.S. PATENT DOCUMENTS 2,436,586 2/1948 Mangold ..... 439/265
3,187,291 6/1965 Hime ..... 439/265
5,108,301 4/1992 Torok ..... 439/265

*Primary Examiner*—Steven L. Stephan
*Assistant Examiner*—Eugene G. Byrd
*Attorney, Agent, or Firm*—LaRiviere, Grubman & Payne, LLP

[57] ABSTRACT

Method for the secure engagement of an electrical plug within its respective receptacle, for increasing the efficacy of the electrical contact therebetween, and apparatus to perform the method. An electrical plug, having reversibly expandable electrically conductive blades, includes an internal swage mechanism which enables the expansion of the blades within the receptacle once the blade has been inserted therein. The swage function is effective without recourse to additional tools.

26 Claims, 3 Drawing Sheets

FIG. 4
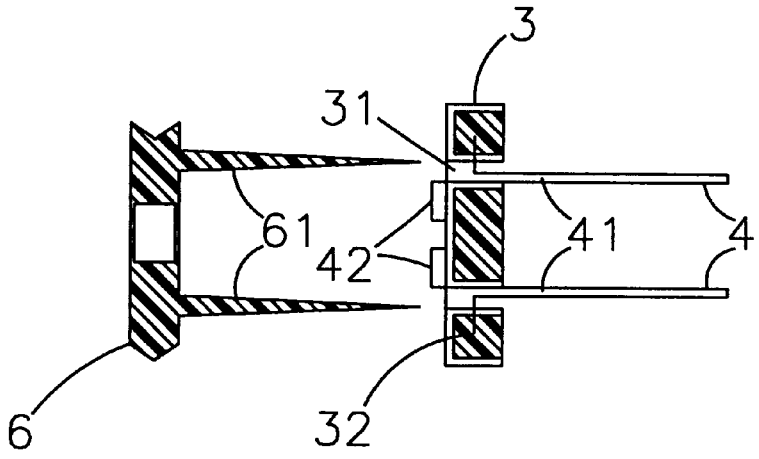
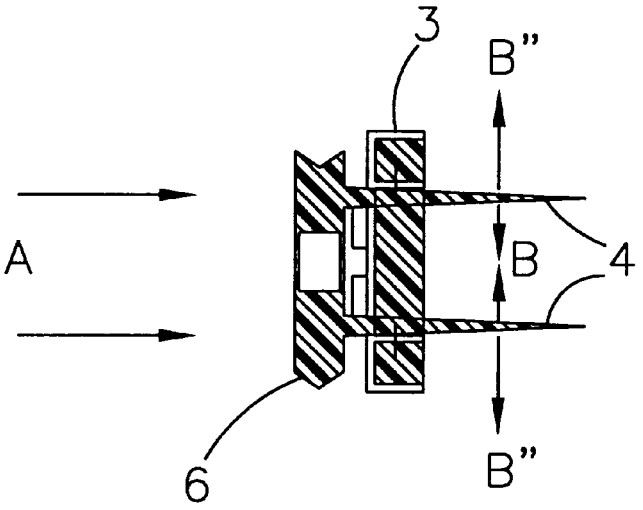
FIG. 5

LOCKING ELECTRICAL CONNECTOR

TECHNICAL FIELD

The present invention relates to electrical and electronic connectors. More particularly, the present invention relates to a method for simultaneously improving the connection between an electrical or electronic plug and its respective receptacle while simultaneously improving the plug's resistance to inadvertent withdrawal from the receptacle, and an apparatus to practice the method.

BACKGROUND ART

Many electrical and electronic applications utilize a removable plug insertable into a receptacle for making a detachable connection. A commonplace example of such a plug/receptacle pairing is the well-known 110 V. service receptacle and mating plug found in most homes. One such exemplar is equivalent to a National Electrical Manufacturers Association (NEMA) 5-15R or 5-15P configuration, and includes a plurality of electrically conductive blades or pins for transmitting electrical power. Similar connectors may be multiple-connector plugs designed for transmitting electrical or electronic signals. By way of illustration, but not limitation, the male portion of such plugs may take the form of blades, pins or prongs, or the like. All such male elements will hereafter by referred to, for clarity, as "blades". It will be obvious to those of ordinary skill in the art that this term comprehends any and all such insertable, or male, plug elements.

In many applications the friction fit provided between the receptacle and the jack, or plug, is completely adequate for its intended purpose. Such an example might include the well-known lamp, or other light-duty electrical appliance. Other electrical connections, however, are more critical and require at once a greater resistance to inadvertent plug withdrawal, and an increased security of electrical contact. Examples of some of these applications include critical alternating current power connections, such as computer power supply connections, audio or audio-visual power supply plugs, and speaker cables. An example of the latter is New Monster Cable® available from Monster Cable®, 274 Wattis Way, South San Francisco, Calif. 94080.

U.S. Pat. No. 4,384,758 teaches an expandable electrical connector of the "banana" type which is expandable by a user within a socket or receptacle. The design taught therein is adequate for single connector plugs, but provides no suggestion as to a methodology for effecting a similar secure connection on multiple connector plugs. What is needed in such plugs is a means for simultaneously engaging and expanding at least one, and preferably a plurality of, the blades of the plug while retaining an electrical separation therebetween.

What is needed then, is a methodology for retaining such electrical, or electronic plugs, especially multiple-connector plugs, tightly engaged in their respective receptacles, while rendering them easily removed when such removal is required. To affect this desirable plug security feature in the electrical trades, for instance for retaining a 110 V. plug in its receptacle, an electrician currently utilizes a screw or screw attachment to and/or through the grounded receptacle plate covering the receptacle. In some electronic applications, there is provided a separate element which attaches to the electric or electronic chassis, chassis receptacle and physically covers the plug. This is most commonly found in situations where the male element is mounted on the chassis and holds a female plug, i.e. an IEC removable power cord. This chassis-attached element does not form part of the IEC power cord assembly itself.

Neither the previously discussed practice of screwing a plug into a receptacle wall plate, or the IEC power cord locking element guarantees a good electrical connection at the electrical contacts.

What is then further needed is a methodology whereby an electrical or electronic multiple connector plug is maintained tightly engaged in its receptacle, retaining to the user the ability to easily remove the plug when such removal is required, while simultaneously improving the electrical contact between the plug elements and receptacle elements as a result of the engagement therebetween, and maintaining the electrical separation of the several plug elements.

DISCLOSURE OF INVENTION

The present invention teaches a method whereby an electrical or electronic plug, for insertion into a receptacle, is rendered capable of increased security of engagement with the receptacle, with a concomitant improvement in electrical connection therebetween. Particularly well suited for use in multiple connector plugs, the methodology taught herein further maintains the electrical separation and integrity of the several plug elements thereof.

The electrical plug taught by the present invention enables the user to insert it into a receptacle, and then securely attach it thereto without the use of tools. This secure engagement is effected by the use of at least one swage, or expander, which is urged into a corresponding blade of the plug, thereby spreading the blade within the receptacle. The expanded blade not only effects a secure mechanical connection with the receptacle, thereby rendering it less prone to inadvertent removal therefrom, but also results in an increasingly secure electrical connection between the blade and the receptacle. In a preferred embodiment of the present invention, the plug formed is a multiple connector plug, and the principles of the present invention teach a methodology for the simultaneous expansion or retraction of a plurality of plug blades.

To effect this reversible simultaneous expansion of a plurality of plug elements their respective swages are mounted on an axially-mounted swage plate, which plate is preferably formed of an electrically insulating material. Further the expanders themselves may, in the alternative or conjointly, also be formed of electrically insulating material. Such insulating material ensures that the several discrete signals carried by the several plug elements, or blades, are discretely maintained.

In use, a user inserts the plug into the receptacle in the normal manner. Subsequent to this insertion, the user urges the internal swage between the elements of a blade, thereby expanding the prong within the receptacle. To remove the plug the user first retracts the swage, and then withdraws the plug from the receptacle. The method whereby the swage, or expander, is urged into engagement with the blade includes, but is not necessarily limited to screws, levers, cams, springs and spring-like urging or impelling devices including, but again not limited to pneumatic, hydraulic, electric, magnetic, hydro-pneumatic, and other urging or impelling methodologies well known to those of ordinary skill in the art.

The apparatus taught herein is applicable to a wide range of electrical and electronic applications including, but again not necessarily limited to, electrical power distribution, audio, visual, audiovisual, electrical signal, electronic signal, data processing, and other detachable electrical connection applications well-known to those of ordinary skill in the art.

Other features of the present invention are disclosed or apparent in the section entitled, "BEST MODE OF CARRYING OUT THE INVENTION".

BRIEF DESCRIPTION OF DRAWINGS

For fuller understanding of the present invention, reference is made to the accompanying drawing in the following detailed description of the Best Mode of Carrying Out the Present Invention. In the drawing:

FIG. 4 shows the swage plate prior to insertion into the blade elements of the plug.

FIG. 5 details the action of the swage after it has been fully inserted into the blades, causing their expansion.

Figure 1:
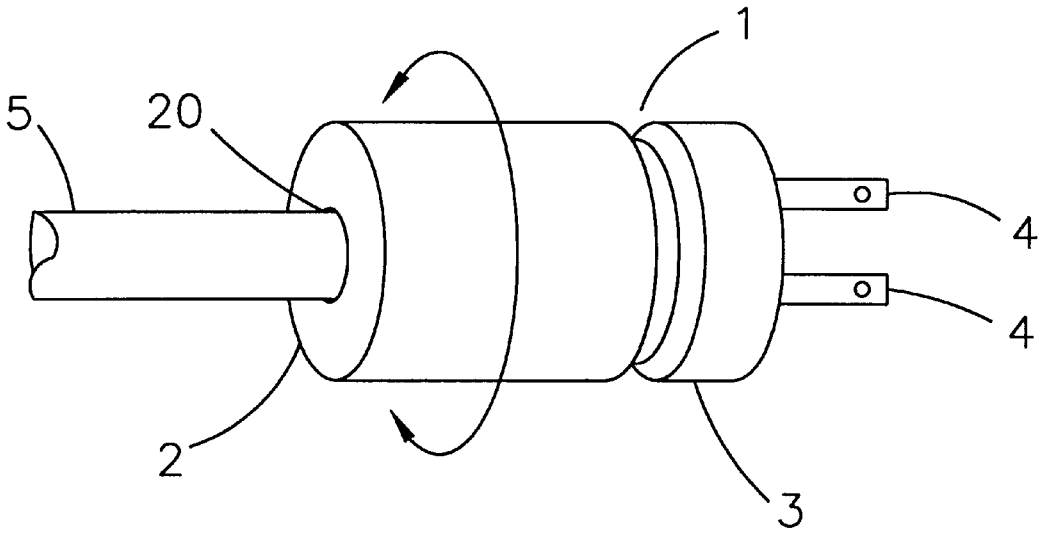
FIG. 1 is an external view of a electrical power distribution plug constructed in accordance with the principles of the present invention.

Reference numbers refer to the same or equivalent parts of the invention throughout the several figures of the drawing.

BEST MODE FOR CARRYING OUT THE INVENTION

Referring now to FIG. 1, an electrical connector plug constructed in accordance with the principles of the present invention is shown implemented as an NEMA 1-15-P electrical plug. While the following discussion centers about this particular implementation, it will be obvious to those of ordinary skill in the art that the principles taught herein are applicable, with equal facility, to a wide variety of electrical and electronic plug applications, most especially to multiple-connector plugs. All such applications are specifically contemplated herewith.

Having continued reference to FIG. 1, plug 1 superficially resembles an electrical service plug, and comprises a shell 2 and a plug body 3. Plug body 3 has in operative combination therewith a pair of reversibly expandable, electrically conductive blades 4 for carrying, in this exemplar, the two phases of 110 volt, 60 Hz, alternating current. Both shell 2 and plug body 3 are electrically non-conductive, or insulative. Shell 2 defines, in this exemplar, an aperture 20 through which an electrical cable, 5, is received. Actuation of the swage mechanism, respectively for expansion or retraction of blades 4, is effected by rotation of shell 2 with respect to plug body 3, as shown by the indicating arrow.

Figure 2:
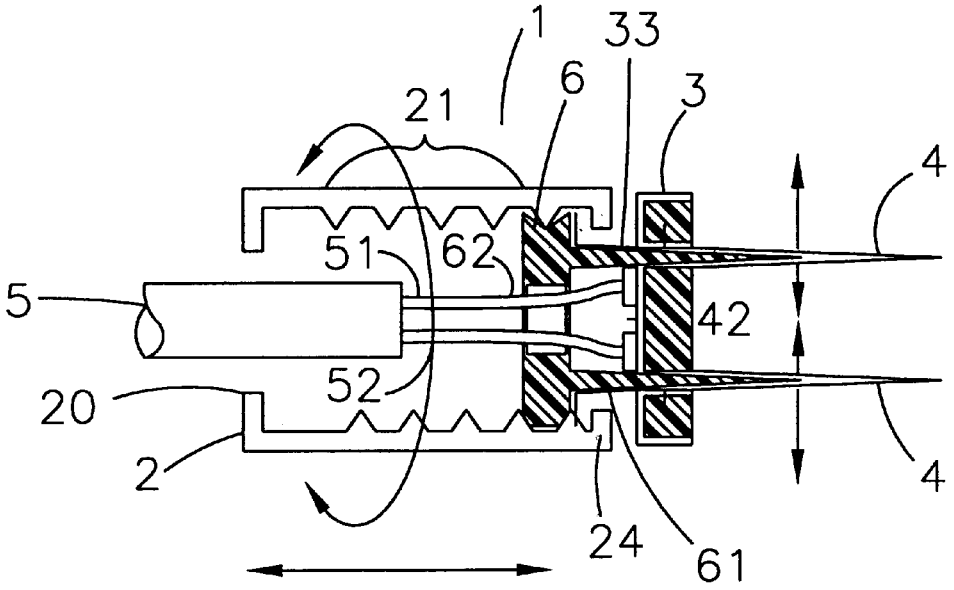
FIG. 2 is a cutaway drawing of the same plug, showing the action of the insertable and retractable swage as it alternately expands and allows to retract the expandable blade elements of the plug blade.

Having reference now to FIG. 2, a transverse section of plug 1 is shown with blades 4 partly expanded by swages 61. Shell 2 of plug 1 has received therein swage plate 6. Swage plate 6 has in operative combination therewith at least one swage, 61. In a preferred embodiment of the present invention for each of a plurality of blades 4, swage plate 6 is fitted with a corresponding plurality of swages 61. Swage plate 6 further defines an aperture 62 through which wires 51 and 52 of electrical cable 5 are led. Wires 51 and 52 carry, in this exemplar, the two phases of electrical power, and are terminated at, and make electrical contact with, their respective blades 4 at blade terminations 42.

Having continued reference to FIG. 2, plug body 3 is linearly retained with respect to shell 2 by means of retaining element 33 which is inserted through and retained within shell 2 at lip 24. This engagement enables the rotation of shell 2 with respect to plug body 3 while retaining their conjoint linear alignment. Swage plate 6 is engaged with a helical thread 21, which provides the urging force to urge swage plate 6 forward and rearward with respect to plug body 3 by the user, thereby reversibly expanding blades 4.

It should be noted that while this preferred embodiment of the present invention teaches the use of a threaded urging methodology, other such urging or impelling methods, including but not necessarily limited to cams, springs, levers, wedges, hydraulic, pneumatic, electrical, electromagnetic, and other urging means well-known to those of ordinary skill in the art may, with equal facility, be implemented. Further, while the urging methodology shown in this preferred embodiment is internal to the plug assembly taught herein, it will be obvious to those having ordinary skill that these urging or impelling methodologies may, with equal facility, be implemented either internal to the plug assembly taught herein or external thereto.

Figure 3:
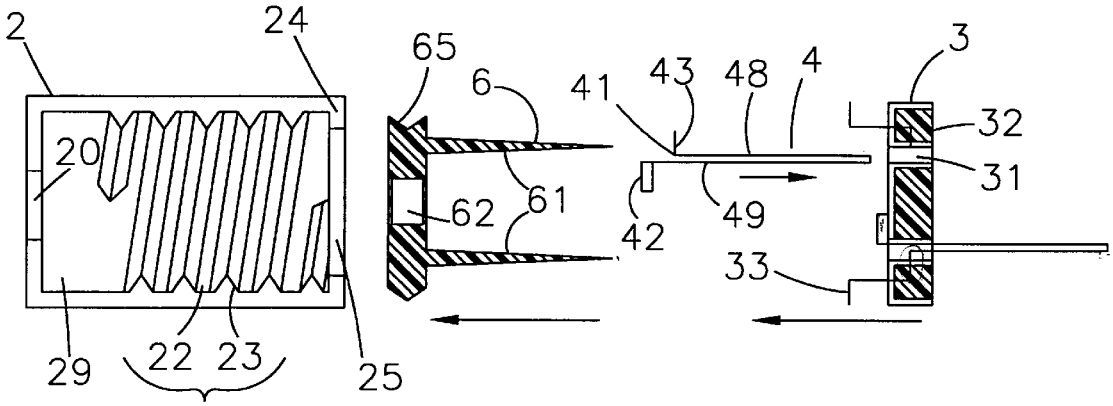
FIG. 3 is an assembly drawing of the plug showing the relationship of the several elements thereof.

Having reference now to FIG. 3, an assembly drawing of plug 1 according to the present invention is shown. As previously discussed, plug 1 comprises, in this preferred embodiment, hollow shell 2; swage plate 6; and plug body 3, plug body 3 having in operative combination therewith at least one reversibly expandable, or expansible blade element 4.

With continued reference to FIG. 3, shell 2 defines an interior cavity 29. Formed about the interior surface of cavity 29 is a helically threaded portion 21, consisting of a helical, wide, flat groove 22, and a helical land, 23. Shell 2 further defines a first aperture 20 through which an electrical cable (not shown) is rendered insertable. Shell 2 further defines a second aperture 25 which aperture further defines a lip 24.

Swage plate 6 is further detailed in FIG. 3. Swage plate 6 is receivable into cavity 29 of shell 2 and is engageable with helically-threaded portion 21 of shell 2 by means of corresponding helically threaded portion 65. This preferred embodiment teaches an engagement by means of forming a second threaded portion, 65, about the external periphery of swage plate 6, which second treaded portion is threadably engageable with the threaded portion 21 of plug body 2. Alternatively, this engagement may be by means of forming the external periphery of swage plate 6 such that its exterior form defines a helix corresponding to the helical form of helically threaded portion 21. Swage plate 6 further defines an aperture 62 through which at least one, and preferably the plurality of wires of the electrical cable for use herewith (not shown) are passed. In this preferred embodiment of the present invention swage plate 6, including swages 61, are unitarily formed of an electrically insulative material. Such insulative or insulating materials include, but are not necessarily limited to: monomeric and polymeric resins; BAKELITE®; plastics; epoxies; various composites; combinations of the foregoing, and all other types of formable materials having acceptable electrical insulating, or dielectric capabilities and wear-resistive properties. One material particularly well suited to this application is Dupont DELRIN®.

Plug body 3 is also shown in FIG. 3. Plug body 3, again formed of one of the previously discussed formable insulating, dielectric, or insulative materials, receives therein at least one, and preferably a plurality of electrically conductive blades 4 as shown in this preferred embodiment. Blades 4 are received within apertures 31, which apertures are defined by plug body 3. Formed in operative combination with aperture 31 is slot 32. Further, plug body 3 has formed in operative combination therewith retainer 33.

With continued reference to FIG. 3, blade 4 is described as follows: blade 4, in this preferred embodiment, comprises a substantially U-shaped conductive tempered brass element which forms the easily recognized electrical blade of an electrical service plug. The arms of blade 4 define therebetween blade cavity 41, as an elongate, axially aligned cavity formed between the two arms, 48 and 49, of blade 4. At least one of arms 48 and 49 of blade 4 is flexible and/or reversibly expandable. Further, one arm, for instance 48, of blade 4 terminates at barb 43 while the other, for instance 49, terminates at wire termination 42. Wire termination 42 is formed to receive therein and to maintain substantial mechanical and electrical contact with an electric wire (not shown).

Blade 4 is inserted into aperture 31 of plug body 3 and barb 43 is engaged with and retained within slit 32. In this fashion, blade 4 is retained within plug body 3, and is rendered connectable to an electrical wire (not shown). Subsequent to the assembly of blades 4 into plug body 3, and the assembly of swage plate 6 into shell 2, plug body 3 is assembled to shell 2. Plug body 3 is retained within shell 2, and in operative combination therewith, by means of retainer 33 engaging lip 24. During the assembly process, swages 61 are aligned with blade cavity 41 as shown in succeeding FIGS. 4 and 5. Alternative blade configurations, including, but necessarily limited to the previously mentioned pins and prongs, may be utilized with equal facility. Such alternative blade configurations will each define therein a longitudinally disposed cavity for inserting therein the swage or expander, and at least one portion thereof for flexibly and reversibly expanding blade 4 into increased contact with a receptacle (not shown).

Having reference now to FIG. 4, the alignment of swage plate 6 with respect to blades 4 and plug body 3 is shown. In this figure, swages 61 are shown just prior to insertion into blade cavities 41. As swages 61 have not yet been inserted into or received within blade cavities 41 in this view, blades 4 remain in their unexpanded form. The alignment shown in FIG. 4 may, in the alternative, be replaced with an alignment methodology whereby the tips of swages 61 are barely inserted within the opening of blade cavities 4, for purposes of retaining the several swages in realignment with respect to their respective blades 4.

Having reference now to FIG. 5, swage plate 6 in operative combination with swages 61 has been urged in the direction of the arrows labeled "A", and is fully engaged within blade cavity 4 of blade 4, thereby outwardly spreading the legs of blade 4 to an expanded form. This expanded form results in the previously discussed advantages regarding security of attachment and increased efficacy of electrical connection. It should be noted that, in the exemplar preferred embodiment shown here, swages 61 take the form of substantially wedge-shaped structures. This shape is highly application dependent, and the principles of the present invention specifically contemplate any geometric shape required to effect a specific expansion configuration. By way of illustration, but not limitation, such geometric shapes include (in cross section) substantially straight structures as well as substantially rounded; ovoid; curved; conical; frustums of cones, linear elements, and the like.

Similarly, while the preferred embodiment disclosed herein shows the insertion of a swage into blade 4 to effect its expansion, the principles of the present invention specifically contemplate an alternative whereby the tip of blade 4 defines an enlarged cavity where an end portion of swage 61, substantially larger in aspect with respect to its shank, is housed. Actuation of swage plate 6, in this embodiment results in the retraction of swage 61 and subsequent reversible expansion of blade 4 responsive thereto.

The present invention has been particularly shown and described with respect to certain preferred embodiments and features thereof. However, it should be readily apparent to those of ordinary skill in the art that various changes and modifications in form and detail may be made without departing from the spirit and scope of the invention as set forth in the appended claims. In particular, the present invention specifically contemplates alternative plug confirmation, blade designs and number, materials, swage geometries, and urging methodologies. The invention disclosed herein may be practiced without any element which is not specifically disclosed herein.

We claim:

1. A multiple-connector electrical plug providing increased security of mechanical attachment and increased efficacy of electrical connection, the connector comprising:

a shell;

a plug body in operative combination with said shell;

a plurality of reversibly expandable and electrically conductive blades disposed on said plug body; and a swage mechanism in operative combination with said shell, said plug body and at least one of said plurality of reversibly expandable and electrically conductive blades for reversibly expanding said one of said plurality of reversibly expandable and electrically conductive blades.

2. The multiple-connector electrical plug of claim 1 wherein at least one of said plurality of reversibly expandable and electrically conductive blades further comprises a substantially U-shaped blade formed of a pair of arms defining therebetween an elongate, axially aligned cavity for receiving therein at least a portion of said swage mechanism.

3. The multiple-connector electrical plug of claim 1 wherein said swage mechanism further comprises means for precluding unwanted electrical contact between individual ones of said plurality of reversibly expandable and electrically conductive blades.

4. The multiple-connector electrical plug of claim 2 wherein at least one of said plurality of reversibly expandable and electrically conductive blades is selected from the group consisting of: elongate blades, prongs and pins.

5. The multiple-connector electrical plug of claim 1 wherein at least one of said plurality of reversibly expandable and electrically conductive blades further comprises a wire termination.

6. The electrical connector of claim 1 wherein at least one of said shell, said plug body and said swage mechanism is formed of a substantially electrically insulating material.

7. A multiple-connector electrical plug providing increased security of mechanical attachment and increased efficacy of electrical connection, the connector comprising:

a shell defining a first cavity, a groove helically formed about an interior surface of said first cavity, a first aperture and a second aperture, said second aperture further defining a lip;

a plug body in operative combination with said shell, said plug body defining a plurality of blade apertures for receiving therein said at least a portion of each one of said plurality of reversibly expandable and electrically conductive blades;

a plurality of reversibly expandable and electrically conductive blades disposed on said plug body; and a swage mechanism in operative combination with said shell, said plug body and at least one of said plurality of reversibly expandable and electrically conductive blades for reversibly expanding said one of said plurality of reversibly expandable and electrically conductive blades.

8. The multiple-connector electrical plug of claim 7 further comprising:

a retainer, disposed on said plug body and engageable with said lip of said shell, whereby said shell is rendered capable of rotation with respect to said plug body while maintaining substantial linear alignment between said shell and said plug body, said shell and said plug body in operative combination thereby forming urging means for urging said swage mechanism into reversibly expansive contact with at least one of said plurality of reversibly expandable and electrically conductive blades.

9. The multiple-connector electrical plug of claim 3 wherein said means for precluding unwanted electrical contact between individual ones of said plurality of reversibly expandable and electrically conductive blades further comprises an electrically insulative swage plate.

10. The multiple-connector electrical plug of claim 2 wherein said swage mechanism further comprises a swage, reversibly insertable into said elongate, axially aligned cavity of said blade, whereby motion of said swage with respect to said blade reversibly expands said blade.

11. The multiple-connector electrical plug of claim 10 wherein said swage mechanism further comprises urging means for reversibly urging said swage into said one of said plurality of reversibly expandable and electrically conductive blades.

12. The multiple-connector electrical plug of claim 11 wherein said urging means is selected from the group consisting of threaded urging means, cam-actuated urging means, spring urging means, lever urging means, wedge urging means, hydraulic urging means, pneumatic urging means, electrical urging means, and electromagnetic urging means.

13. The multiple-connector electrical plug of claim 11 wherein said urging means is disposed internally within said shell.

14. The multiple-connector electrical plug of claim 11 wherein said urging means is disposed external to said shell.

15. A multiple-connector electrical plug providing increased security of mechanical attachment and increased efficacy of electrical connection, the connector comprising:

a shell;

a plug body in operative combination with said shell;

a plurality of reversibly expandable and electrically conductive blades disposed on said plug body; and a swage mechanism in operative combination with said shell, said plug body and at least one of said plurality of reversibly expandable and electrically conductive blades for reversibly expanding said one of said plurality of reversibly expandable and electrically conductive blades, wherein said swage mechanism further comprises:

a groove helically disposed upon at least a portion of an interior surface of said first cavity of said hollow shell;

an electrically insulative swage plate received into said first cavity of said shell;

a helically threaded portion disposed on at least a portion of said swage plate whereby said swage plate is rendered threadably engageable with said groove in said hollow shell; and a swage, disposed on said swage plate and axially aligned with said one of said plurality of reversibly expandable and electrically conductive blades.

16. The electrical connector of claim 10 wherein at least a portion of said swage has an external shape selected from the group consisting of round, ovoid, curved, conical, frustums of cones, linear and wedge-shaped.

17. The electrical connector of claim 10 further comprising means for retaining said swage in realignment with respect to said blade.

18. The electrical connector of claim 6 wherein said substantially electrically insulating material is selected from the group consisting of: monomeric resins, polymeric resins; bakelites; plastics; epoxies; composite materials; and combinations thereof.

19. The electrical connector of claim 17 wherein said means for retaining said swage in alignment with respect to said blade further comprises at least a portion of said swage inserted within at least a portion of said.

20. A multiple-connector electrical connector plug providing increased security of mechanical attachment and increased efficacy of electrical connection, the connector comprising:

a hollow shell defining a first cavity, a groove helically formed about an interior surface of said first cavity, a first aperture and a second aperture, said second aperture further defining a lip;

a plug body defining a plurality of blade apertures and a retainer engageable with said lip of said shell whereby said shell is rendered capable of rotation with respect to said plug body while maintaining substantial linear alignment between said shell and said plug body;

a plurality of substantially U-shaped, reversibly expandable and electrically conductive blades, each of said plurality of substantially U-shaped, reversibly expandable and electrically conductive blades received within a one of said plurality of said blade apertures, each of said plurality of substantially U-shaped, reversibly expandable and electrically conductive blades formed of a pair of arms defining therebetween an elongate, axially aligned cavity, and each of said plurality of substantially U-shaped, reversibly expandable and electrically conductive blades terminating at a wire termination;

an electrically insulative swage plate received into said first cavity of said shell, said swage plate including a third aperture, a helically threaded portion engageable with said groove of said shell, and a plurality of swages, each of said plurality of said swages aligned with a corresponding one said elongate, axially aligned cavity of each of said plurality of said blades;

whereby said shell, said swage plate, and said swages form, in operative combination, a swage mechanism effected by rotation of said shell with respect to said plug body, said helically threaded portion of said swage plate being threadably engaged with said groove of said shell thereby providing an urging force whereby said swage plate is rendered urgeable with respect to plug body by a user, thereby reversibly and insertably urging said plurality of said swages into engagement with said plurality of said blades, and reversibly expanding said plurality of said blades.

21. The electrical connector of claim 20 wherein at least one of said shell, said plug body and said swage plate is formed of a substantially electrically insulating material.

22. The electrical connector of claim 21 wherein said substantially electrically insulating material is selected from the group consisting of: monomeric and polymeric resins; bakelites; plastics; epoxies; composites: and combinations thereof.

23. The electrical connector of claim 20 wherein at least a portion of at least one of said plurality of said swages has an external shape selected from the group consisting of round, ovoid, curved, conical, frustums of cones, linear and wedge-shaped.

24. The electrical connector of claim 20 wherein at least a portion of said at least one of said plurality of said swages is inserted into at least a portion of a corresponding one of said elongate, axially aligned cavities of said reversibly expandable and electrically conductive blades, whereby said swage is retained in alignment with said corresponding one of said elongate, axially aligned cavities.

25. In a multiple-connector electrical plug, the method of providing increased security of mechanical attachment and increased efficacy of electrical connection, the method comprising the steps of:

providing a shell;

disposing a plug body in operative and combination with said shell;

disposing, on said plug body, a plurality of reversibly expandable and electrically conductive blades; and with a swage mechanism in operative combination with said shell, said plug body and at least one of said plurality of reversibly expandable and electrically conductive blades, reversibly expanding said at least one of said plurality of reversibly expandable and electrically conductive blades.

26. In a multiple-connector electrical plug, the method of providing increased security of mechanical attachment and increased efficacy of electrical connection, the method comprising the steps of:

forming a groove helically about an interior surface of a hollow shell;

defining a lip on an aperture further formed on said hollow shell;

with respect to a plug body defining a plurality of blade apertures and a retainer engageable with said lip of said shell, rendering said shell rotatable by engaging said lip with said retainer while maintaining substantial linear alignment between said shell and said plug body;

providing a plurality of substantially U-shaped, reversibly expandable and electrically conductive blades, each of said plurality of substantially U-shaped, reversibly expandable and electrically conductive blades received within a one of said plurality of said blade apertures, each of said plurality of substantially U-shaped, reversibly expandable and electrically conductive blades formed of a pair of arms defining therebetween an elongate, axially aligned cavity, and each of said plurality of substantially U-shaped, reversibly expandable and electrically conductive blades terminating at a wire termination;

receiving into said first cavity of said shell an electrically insulative swage plate including a helically threaded portion and a plurality of swages, engaging said helically threaded portion with said groove of said shell; and aligning each of said plurality of said swages aligned with a corresponding one said elongate, axially aligned cavity of each of said plurality of said blades, whereby said shell, said swage plate, and said swages forming, in operative combination, a swage mechanism effected by rotation of said shell with respect to said plug body, said helically threaded portion of said swage plate being threadably engaged with said groove of said shell thereby providing an urging force whereby said swage plate is rendered urgeable with respect to plug body by a user, thereby reversibly and insertably urging said plurality of said swages into engagement with said plurality of said blades, and reversibly expanding said plurality of said blades.

* * * * *